US006279681B1

(12) United States Patent
Dibelardino et al.

(10) Patent No.: US 6,279,681 B1
(45) Date of Patent: Aug. 28, 2001

(54) COLLAPSIBLE LADDER HAVING HIGHLY NESTING RUNGS WITH INTEGRAL STAND-OFF PROJECTIONS

(75) Inventors: Aldo J. Dibelardino, Virginia Beach, VA (US); Andrew D. Ive, San Ramon, CA (US); Ezio C. Dibelardino, Norfolk, VA (US)

(73) Assignee: X-IT Products, LLC, Norfolk, VA (US)

( * ) Notice: Subject to any disclaimer, the term of this patent is extended or adjusted under 35 U.S.C. 154(b) by 0 days.

(21) Appl. No.: 09/542,862

(22) Filed: Apr. 4, 2000

Related U.S. Application Data

(62) Division of application No. 09/075,180, filed on May 11, 1998, now abandoned.

(51) Int. Cl.[7] ..... E06C 1/52
(52) U.S. Cl. ..... 182/198; 182/228.1
(58) Field of Search ..... 182/196, 197, 182/198, 70, 228.1

(56) References Cited

U.S. PATENT DOCUMENTS

| | | | | |
|---|---|---|---|---|
| 314,287 | | 3/1885 | Fiegenbaum . | |
| 800,934 | * | 10/1905 | McArthur . | |
| 1,424,115 | | 7/1922 | Nileon . | |
| 3,307,654 | | 3/1967 | Green et al. . | |
| 3,415,341 | * | 12/1968 | Hostetler . | |
| 4,098,372 | | 7/1978 | Luckey . | |
| 4,243,121 | | 1/1981 | Kiss et al. . | |
| 4,298,097 | | 11/1981 | Eriksson . | |
| 4,846,306 | | 7/1989 | Ventz . | |
| 5,605,205 | | 2/1997 | Douglas et al. . | |
| 5,628,380 | | 5/1997 | Matisi . | |
| 5,971,105 | * | 10/1999 | Jacobson | 182/198 |

FOREIGN PATENT DOCUMENTS

| | | | | |
|---|---|---|---|---|
| 2828 211 | | 8/1979 | (DE) . | |
| 196 38 704 | | 4/1998 | (DE) . | |
| 471 433 | * | 7/1914 | (FR) | 182/197 |
| 1285334 | * | 8/1972 | (GB) | 182/196 |
| 2230813 | | 10/1990 | (GB) . | |
| 147926 | * | 11/1954 | (SE) | 182/196 |
| 211210 | | 7/1966 | (SE) . | |
| 211216 | * | 7/1966 | (SE) . | |

* cited by examiner

*Primary Examiner*—Alvin Chin-Shue
(74) *Attorney, Agent, or Firm*—Arnold International; Bruce Y. Arnold

(57) ABSTRACT

A collapsible ladder having rungs of a relatively strong and thin material with integral stand-off projections that allow the ladder to be safely descended and of a cross-section that allows the ladder rungs to nest to a high degree of compactness. The ladder is readily deployed by means of a cover having two sets of temporary fasteners. In an emergency, the ladder is deployed by partially unwrapping the cover to a first state which allows an attaching member to be removed and placed over a window sill. After insuring that narrow fabric supports, which attach the attaching member to the rungs, are not twisted between the attaching member and a top rung of the ladder, the multiple rungs (still wrapped by the cover and secured by a second set of temporary fasteners) are supported using a handle attached to the cover. The handle is then held outside the window and dropped. The momentum of the filling package of rungs is sufficient to open the second set of temporary fasteners and thereby reliable deploy the ladder in its proper orientation. Also disclosed is an attaching plate, which may optionally be used to stabilize the attaching member to a wall surface beneath a window sill and to ensure that the attaching member will attach securely over any window sill, regardless of the thickness of the wall.

3 Claims, 10 Drawing Sheets

COLLAPSIBLE LADDER HAVING HIGHLY NESTING RUNGS WITH INTEGRAL STAND-OFF PROJECTIONS

This is a divisional application of U.S. Ser. No. 09/075,180, filed May 11, 1998, abandoned, the benefit of priority of which is claimed under 35 U.S.C. 120.

BACKGROUND OF THE INVENTION

There has long existed a need for a light-weight, collapsible ladder that may be secured to, for example, a window or other aperture of a multi-story building in order to provide occupants of the building a secondary route of escape during a fire. Many patents disclose inventions which are intended to fulfill this long-felt need. For example, U.S. Pat. No. 190,342 to Lake discloses a collapsible ladder having rungs that are secured together by metal rods which are formed into rectangular shapes so as to secure two rungs together in a non-collapsed condition of the ladder.

Each rung (except the bottom rung) has two sets of holes which are spaced forward and backward on the tread of the rung, with one set of holes for securing the ladder rung from above and the other set of holes for securing the next ladder rung below.

U.S. Pat. No. 314,287 to Feigenbaum discloses a rope ladder having round rungs which fit between the floor joists of a building, the ladder being deployed when a trap door is removed and put out of the way so as to allow the ladder to be let down to the floor below.

U.S. Pat. No. 1,424,115 to Nileon discloses a rope ladder having hollow tubular rungs, with the ends of the rungs having one-half removed so as to be semi-circular in cross-section and bent at a right angle to tightly bind a cable, and at the same time engage a wall of a building, whereby the ladder rung will be held away from the side of a building a distance sufficient to permit the user to gain a foot hold on the ladder rung.

U.S. Pat. No. 4,098,372 to Luckey discloses a collapsible ladder made of a non-combustible material having two flexible strings with rungs threaded thereon at spaced distances.

These rungs have divergent limbs so that, when the ladder is collapsed, the rungs may be stacked on one another in such a way as to leave between each pair of adjacent rungs a free hollow area for complete reception of segments of a cable or strip elements which support the rungs when the ladder is in use.

U.S. Pat. No. 4,298,097 to Eriksson discloses an escape ladder assembled of rungs, the ends of which are attached between flexible lateral members, with the rungs being of metal material and capable of being stacked, and with the upper portion of the escape-ladder intended to be attached to a wall or the like.

U.S. Pat. No. 4,846,306 to Ventz discloses a rope escape ladder including a pair of parallel support ropes and a series of narrow rungs disposed between the support ropes, wherein the rungs are so narrow that no more than one hand or one foot can be placed on a rung at a time.

U.S. Pat. No. 5,605,205 to Douglas et al discloses a collapsible ladder having hooks for securing to a window surface, a rigid spacing member extending between the hooks and defining a slot, an elongated flexible support element of nylon rope or steel cable attached to the hooks, a plurality of rungs, formed from a molding process, that stack and nest with a storage region between each rung for storing the flexible support, a fastener to connect each rung to the flexible support, and a cover for holding the rungs in the nested state. The cover has a neck portion, and a handle which extends through the slot in the rigid spacing member. The handle is movable in the slot to thereby release the cover and deploy the ladder to the extended state.

Despite a myriad of patents having addressed the need for a light-weight, collapsible ladder for over a century of development, there remains the need for a light-weight escape ladder which can be easily deployed and safely descended in a fire emergency in case the primary means of escape (such as a stairwell) is blocked and wherein, in the collapsed state, the rungs of the ladder nest to a high degree of compactness.

BRIEF SUMMARY OF THE INVENTION

The present invention provides a very compact, collapsible ladder that is light in weight, yet can be rapidly deployed and safely descended during a fire emergency. A first object of the invention is to insure that the ladder is safe and easy to descend. A second object of the invention is to provide a cover with handle that allows the ladder to be easily and reliably deployed by dropping the handle out a window once an attaching member has been placed over the sill of the window. A third object of the invention is to minimize the space required to store the collapsible ladder when not in use.

BRIEF DESCRIPTION OF THE DRAWINGS

The present invention will be more fully understood from the below detailed description and the accompanying drawings. The various embodiments of the invention are given by way of illustration only, and thus, are not intended to limit the scope of the invention, wherein.

DETAILED DESCRIPTION

As used herein, "highly nesting" and "high degree of compactness" refer to rungs that nest in a stack having 10 or more rungs per 6 inches (15.2 cm) of stack height when in the collapsed state.

Figure 1:
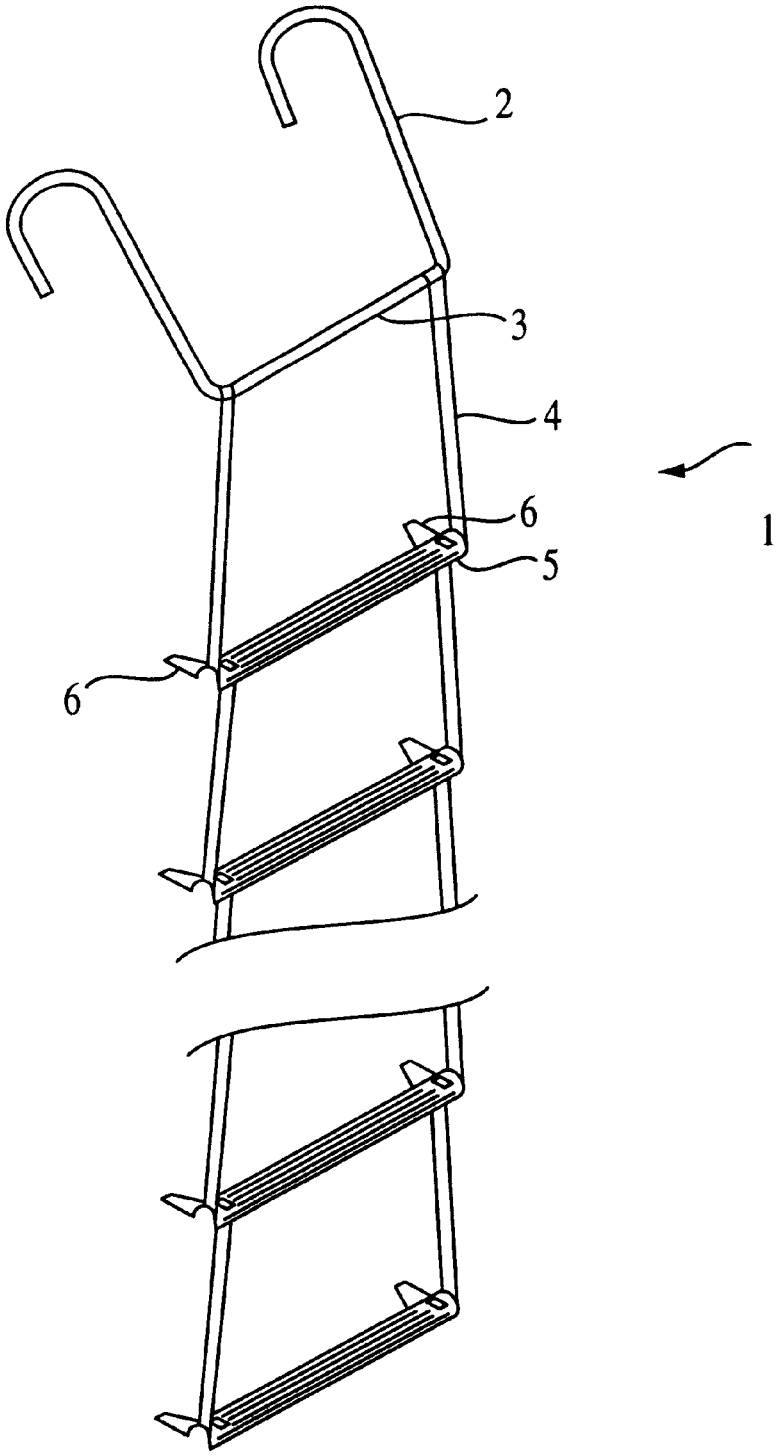
FIG. 1 illustrates a perspective view of the ladder of the present invention when in the deployed state.

Referring to FIG. 1, a perspective view of the ladder 1 in its deployed state is illustrated. The ladder includes an attaching member 2 having two hooks, each with an open end facing the same direction so that the attaching member 2 may be hooked over a window sill (not illustrated). The attaching member 2 is of tubular construction which may be solid or hollow (not illustrated) and includes a support bar 3 to which may be attached one or more narrow fabric supports 4, made of a webbing material such as nylon (or any other known, flame resistant, high strength, light weight synthetic material) for supporting the rungs 5 of the ladder 1. The narrow fabric support should be able to support a load of about 3,000 pounds (1,364 kilograms) and, in the preferred embodiment, is made of nylon that measures about 1 inch (2.54 cm) wide and ⅛ inch (3.18 mm) thick.

The rungs 5 of the ladder are made of a thin, high-strength material such as metal, preferably aluminum having a thickness of about 1/16 inch to 1/12 inch (1.6 mm to 2.0 mm). Other materials having a tensile strength of about 10 kpsi (7 $kg/mm^2$) or higher, such as steel, titanium, carbon-filament, etc., may be substituted for aluminum. Having the rungs made of a high-strength material enables the rungs to be strong even though the thickness of the rung material is less than ¼ inch (6.4 mm), and is one of the factors that enables the rungs to be nested to a "high degree" in the collapsed state. If the rungs are made of a sheet metal, such as steel or aluminum, this allow the rungs to be economically produced by stamping; however, the rungs may also be produced in other ways, such as by using extruded aluminum or molded materials. An important feature of the rung design is that there is a stand-off projection 6, positioned at or near each rung end, which is integral to the rung. The stand-off projections 6 are for the purpose of making the ladder easy and safe to descend by ensuring that each rung is positioned a minimum distance from a wall, thereby allowing room for one's toes so that the ball of the foot may be placed squarely on the rung as one descends the ladder. In the situation where the rungs are shaped by being extruded, the two stand-off projections 6 may be formed by removing metal from between the rung ends as, for example, by stamping. In this way, the weight of each rung may be kept low. A friction-enhancing material or pattern (not illustrated) may be applied to, or formed on, the top portion of the rung which forms the tread of each ladder step. Preferably, the tread portion of the step is at least one inch in width so as to provide a comfortable support, even for a user without shoes.

Another important feature of the rung design is that the multiple rungs of the ladder nest to a high degree of compactness, and with the narrow fabric support folded toward the center of each rung, thereby ensuring that the ladder is very compact in the collapsed state and deploys properly without tangling when the multiple rungs in the collapsed state are dropped as a bundle, as will be described in more detail with reference to a later figure.

The preferred embodiment of the present invention, as well as most other illustrated embodiments, meet American National Standards Institute Standard No. 14.2—1990. In addition, the narrow fabric support of the present invention meets the National Fire Prevention Association 701—Standard Methods of Fire Tests for Flame Resistant Textiles and Films (Small-Scale Test).

Figure 2A:
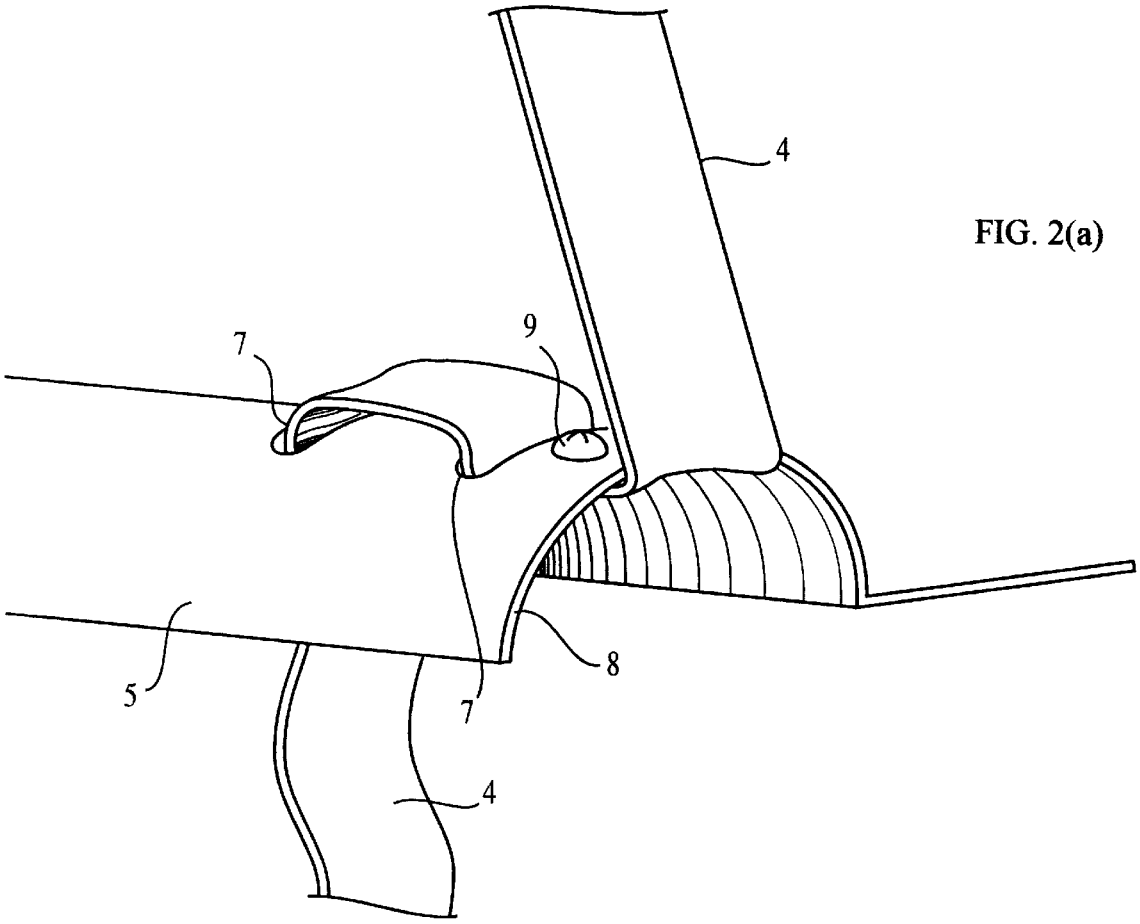
FIGS. 2(*a*) and 2(*b*) illustrate perspective and cross-sectional views, respectively, of a rung of the ladder illustrated in FIG. 1.
Figure 2B:
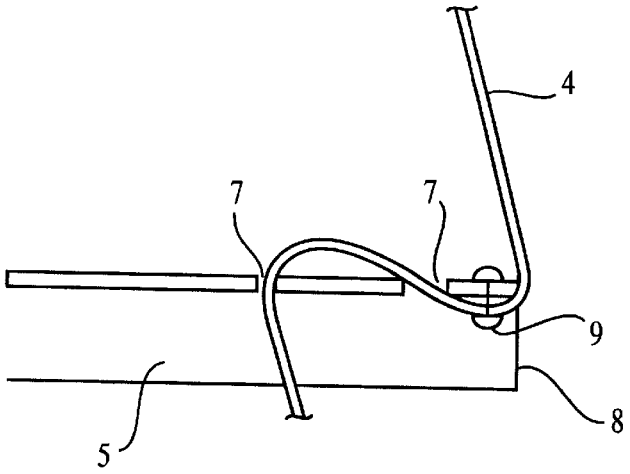

FIG. 2(*a*) and 2(*b*) are perspective and cross-sectional views, respectively, of a first embodiment of a rung of a ladder according to the present invention. According to this embodiment, there are two slots 7 near the end 8 of each rung, and the rung-end cross-section is arcuate in shape, with the arc radius being three inches or greater. These figures also show how one or more narrow webbing or fabric supports 4 may be sequentially threaded through the slots 7 and fastened with a fastener such as a rivet 9 in order to support the rungs 5 at fixed vertical spacings when the ladder is in use.

Figure 3A:
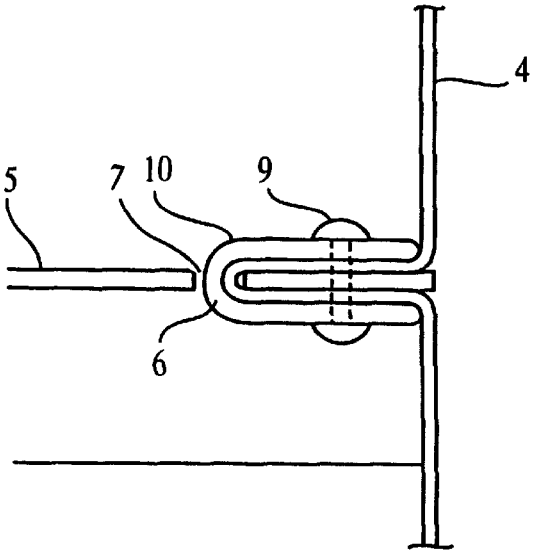
FIGS. 3(*a*)–3(*c*) illustrate cross-sectional views of alternative techniques for fastening a narrow webbing or fabric support to a modified rung having a single slot, near each rung end, through which the narrow fabric support is threaded.
Figure 3B:
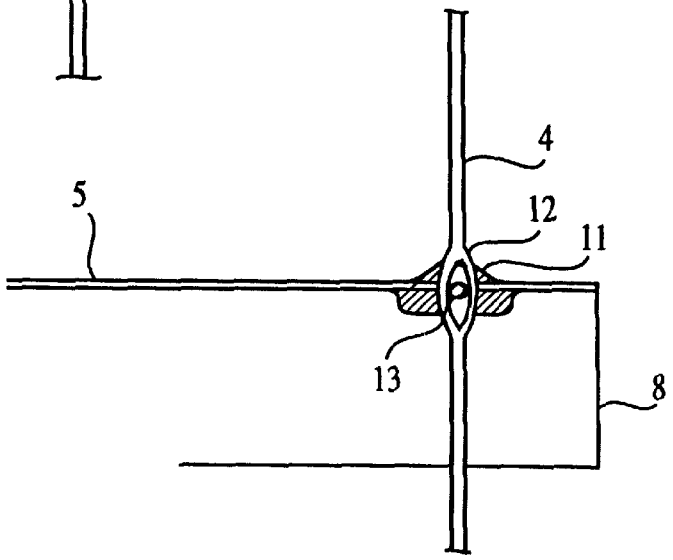
Figure 3C:
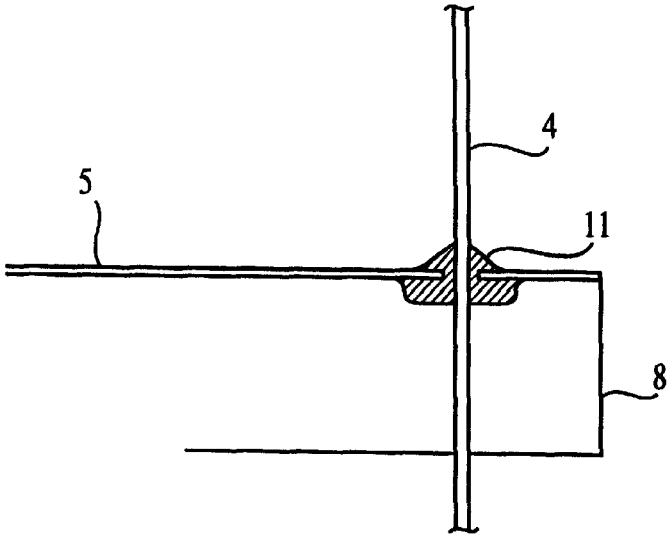

FIGS. 3(*a*)–3(*c*) illustrate cross-sectional views of alternative techniques for fastening one or more narrow fabric supports 4 to a modified rung having a single slot 7, near each rung end 8, through which the narrow fabric support 4 is threaded. Referring to FIG. 3(*a*), a clip 10 has been inserted through the single slot 7 to spread out the stress on the narrow fabric support 4. Rivet 9 fastens the clip 10 in place. In FIGS. 3(*b*) and 3(*c*), a compression fastener 11 is used to grip the narrow fabric support. The narrow fabric support may itself be woven with one or more slits 12 which may then be separated by a spacing member 13, such as the rod illustrated in FIG. 3(*b*), which functions to support the rung 5.

Figure 4:
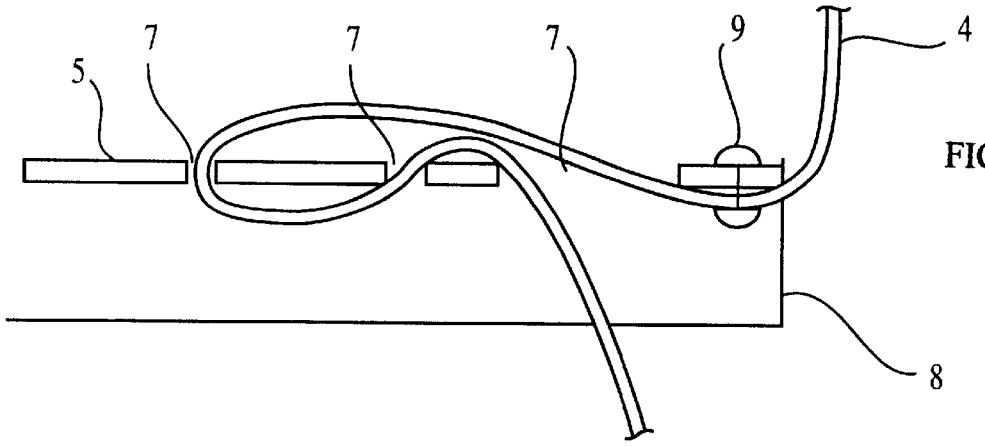
FIG. 4 is a cross-sectional view which illustrates an alternative way to thread the narrow fabric support to a rung having three slots on each end.

FIG. 4 is a cross-sectional view which illustrates an alternative way to thread the narrow fabric support 4 to a rung having three slots 7 near each rung end 8.

Figure 5A:
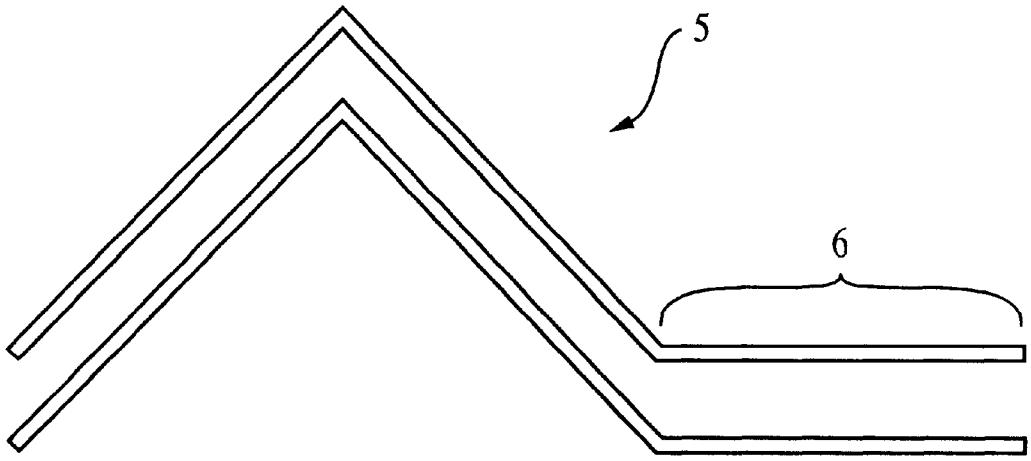
FIGS. 5(*a*) and 5(*b*) are cross-sectional views of alternative rung cross-sections, with each rung made of an elongate material having an integral stand-off projection positioned at each end of each rung, wherein each rung is, substantially, identically-shaped of linear segments and sized the same as the other rungs, and all the rungs of the ladder nest to a high degree of compactness when the ladder is in the collapsed state.
Figure 5B:
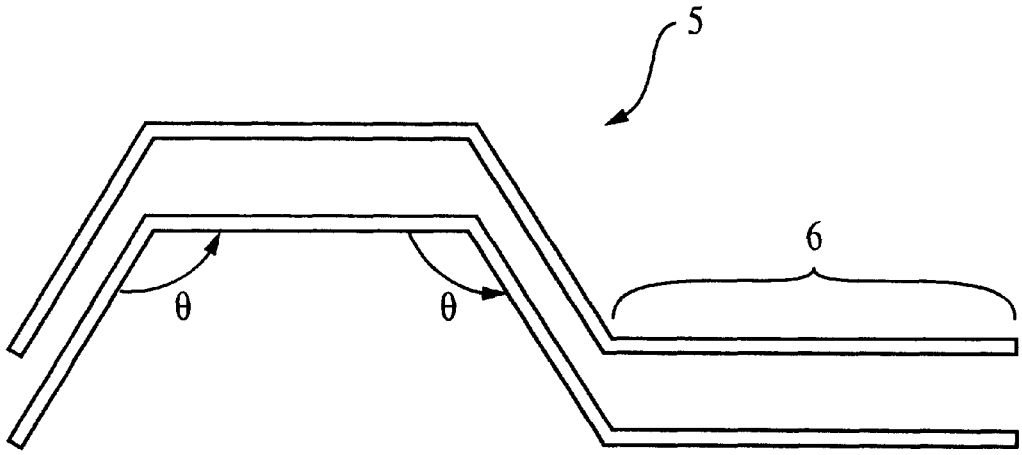

FIGS. 5(*a*) and 5(*b*) are cross-sectional views of pairs of rungs that stack and nest to a high degree. The rung pairs illustrated in these two figures have different cross-sections, with each rung including an integral stand-off projection 6 near each end. The cross-section illustrated in FIG. 5(*a*) is that of an inverted V, which is less desirable than the cross-section illustrated in FIG. 5(*b*) because there is insufficient support surface at the inverted V vertex to comfortably stand on the ladder rung without shoes. The cross-section illustrated in FIG. 5(*b*) is that of an inverted channel, with a top flat surface which is at least 1 inch wide. These figures give examples of alternative rung cross-sections wherein each rung 5 is identically shaped of linear segments, is identically sized with the other rungs of the ladder, and all the rungs of the ladder both stack and nest to a high degree when the ladder is in the collapsed state.

Figure 6A:
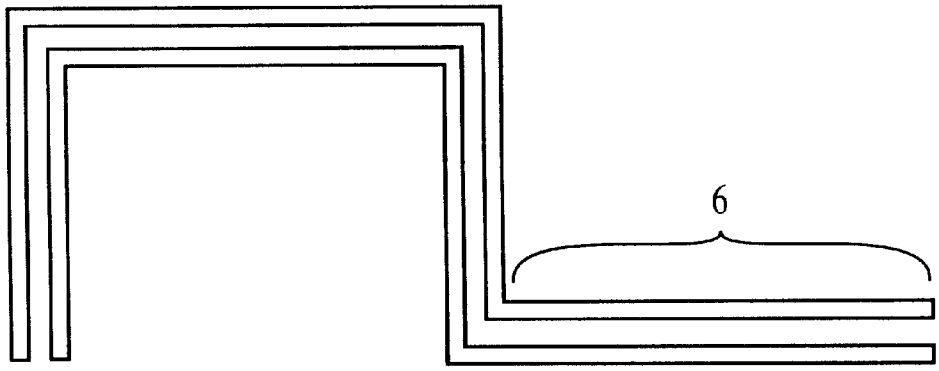
FIGS. 6(*a*) and 6(*b*) are cross-sectional views of other alternative rung cross-sections, with each rung made of an elongate material having an integral stand-off projection positioned at each end of each rung, wherein each rung is sized differently from the other rungs of the ladder and the rungs nest to a high degree of compactness when the ladder is in the collapsed state.
Figure 6B:
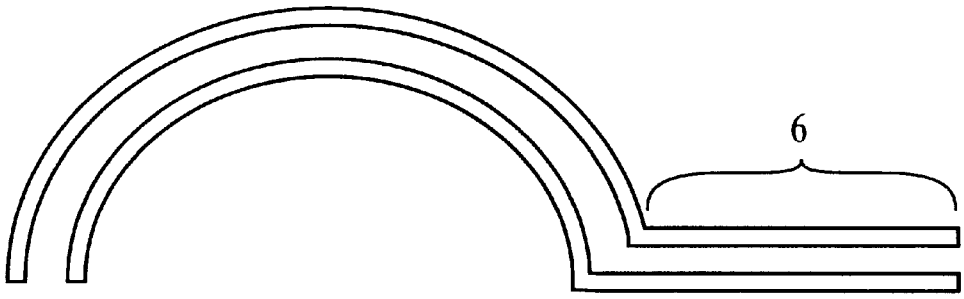

FIGS. 6(*a*) and 6(*b*) are additional cross-sectional views of pairs of rungs that stack and nest to a high degree. The rung pairs illustrated in these two figures have still different crosssections, with each rung end including an integral stand-off projection 6 and each rung having a minimum step surface of at least 1 inch in width, FIG. 6(*a*), or a minimum arc radius of 3 inches, FIG. 6(*b*). These figures give examples of alternative rung cross-sections wherein each rung is sized differently from the other rungs of the ladder, and wherein all the rungs of the ladder both stack and nest to a high degree when the ladder is in the collapsed state.

Figure 7:
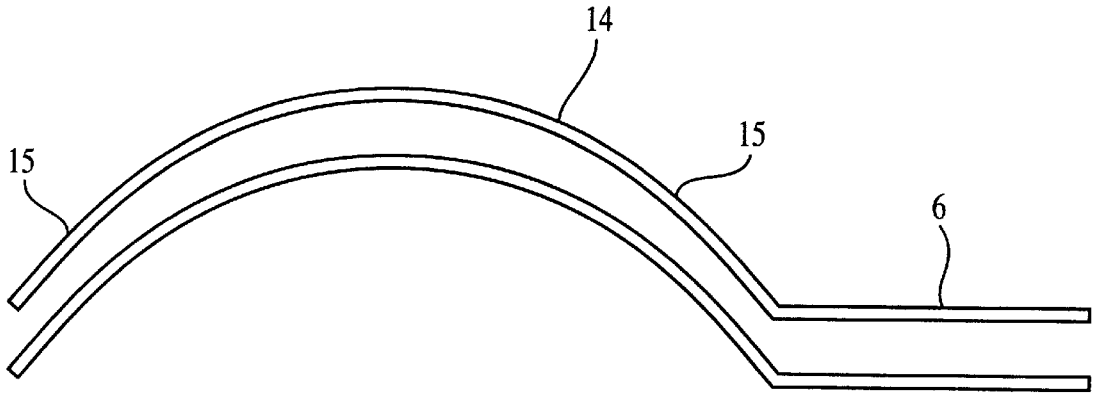
FIG. 7 is a cross-sectional view of the ladder rung of the preferred embodiment of the invention, each rung being formed so as to have an arc-shaped portion in a region including the top portion of each rung, with a straight flange on at least one side of the arc-shaped portion, and wherein each rung end includes an integral, stand-off projection, is sized substantially identically with the other rungs of the ladder, and the rungs nest to a high degree of compactness in the collapsed state of the ladder.

FIG. 7 is a cross-sectional view of a pair of rungs of a design that is the preferred embodiment of the invention, wherein each rung is formed so as to have an arc-shaped portion 14 having a minimum arc radius of 3 inches and an arc width of at least 1 inch in a region including the top portion of each rung, with a straight flange 15 on at least one side of the arc-shaped portion, wherein each rung end includes an integral, stand-off projection 6, each rung is sized identically with the other rungs of the ladder, and the rungs both stack and nest to a high degree in the collapsed state of the ladder.

Figure 8:
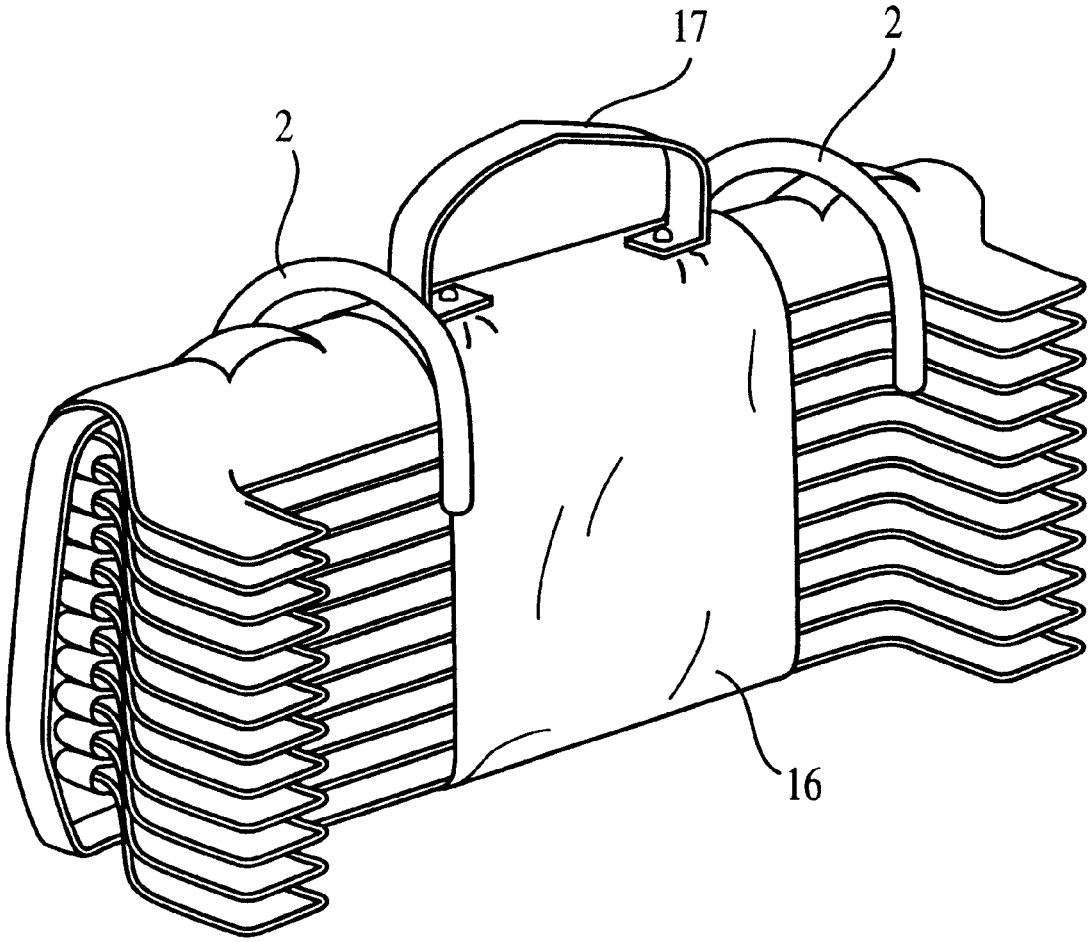
FIG. 8 illustrates a perspective view of the ladder of the present invention when in the non-deployed, collapsed state and bound by a cover that aids in picking up the ladder (as, for example, from a storage box) and in dropping the ladder rungs as a group, once an attaching member has been hooked over window sill, in order to deploy the ladder in a tangle-free manner during a fire or other emergency.
Figure 9A:
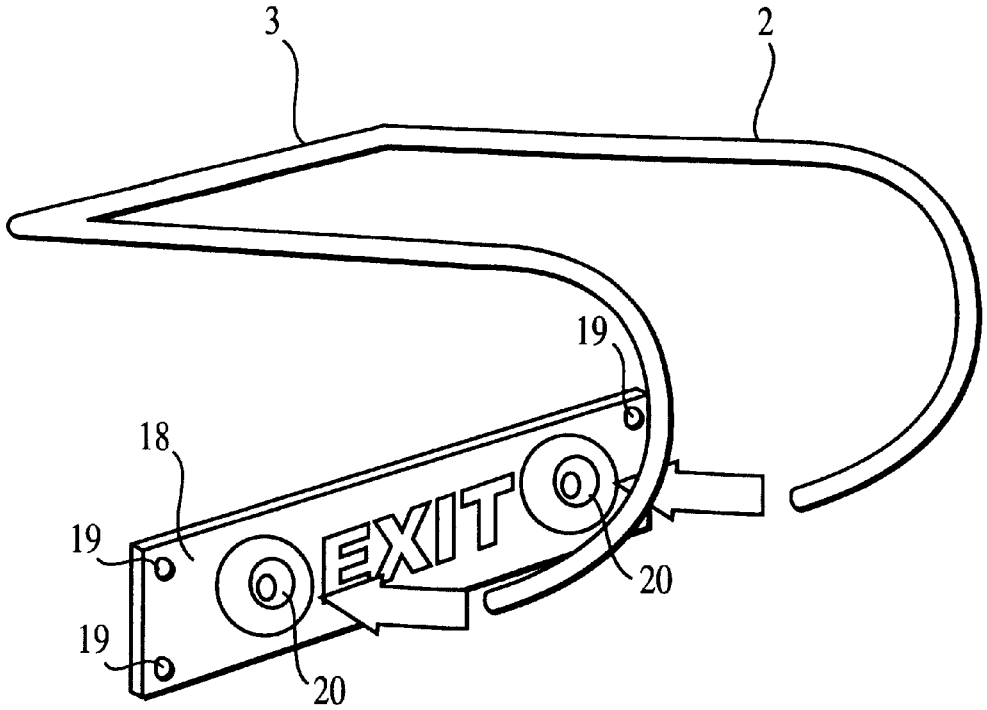
FIGS. 9(*a*) and 9(*b*) illustrate a mounting plate labeled "EXIT" which may be mounted to a wall surface beneath a window sill for an attaching member and for marking the window as an exit route for use as a secondary means of escape during an emergency, such as a fire.
Figure 9B:
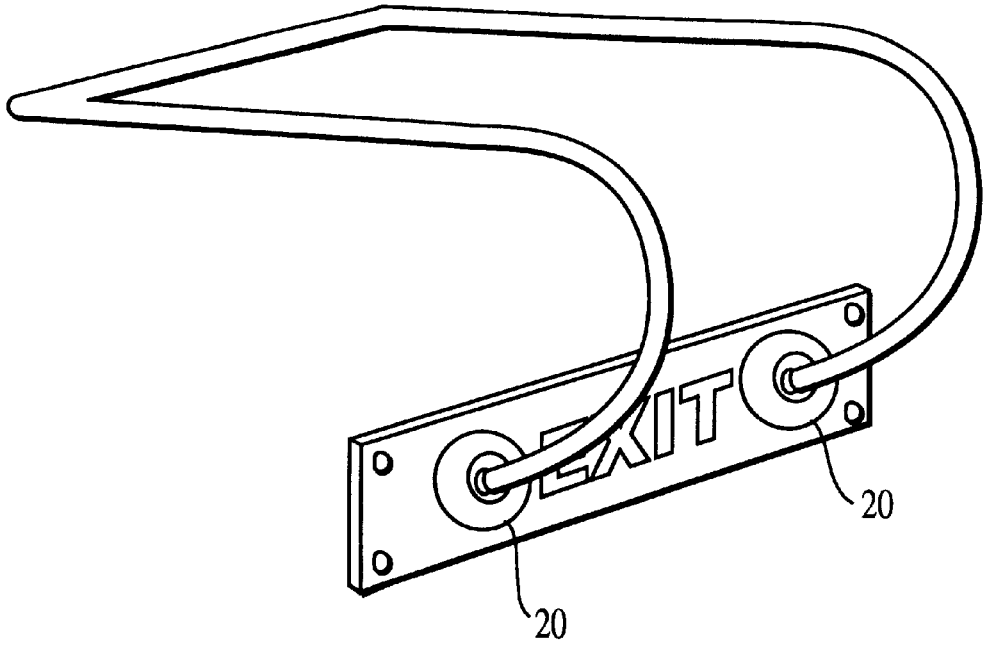

FIG. 8 illustrates a perspective view of the ladder of the present invention when in the non-deployed, collapsed state and bound by a cover 16 having a handle 17. The handle aids in picking up the ladder with one hand (as, for example, from a storage box) and in dropping the ladder rungs as a group (once the attaching member 2 has been hooked over the window sill using the other hand) in order to deploy the ladder in a tangle-free manner during a fire or other emergency;

FIGS. 9(*a*) and 9(*b*) illustrate a mounting plate 18 (which optionally may be labeled "EXIT", as illustrated) and which may be mounted to a wall beneath a window sill (not illustrated). The mounting plate may be mounted with fasteners such as screws (not illustrated) through holes 19. On the mounting plate are two openings which may, for example, include support collars 20 for receiving the open ends of the attaching member 2. The openings and/or support collars allow the ends of the tubular material of the attaching member to be inserted and prevent motion of the ends in all radial directions. The arrows in FIG. 9(*a*) illustrate the direction in which the open ends of the attaching member 2 are inserted into the support collars 20. FIG. 9(*b*) illustrates the attaching member 2 with its open ends fully inserted into the openings in the support collars 20 of the mounting plate 18 so as to fix the open ends from moving in any radial direction.

The mounting plate 18 serves three functions. First, it labels the window as an exit so that the occupants of the building may be reminded that the window has been designated as a secondary escape route during a fire or other emergency. Second, it supports the open ends of the attaching member so that the attaching member may be securely positioned on the window sill. Third, it provides a universal fitting which ensures that the attaching member 2 will seat properly over almost any design of window sill, regardless of the thickness of the wall.

Figure 10A:
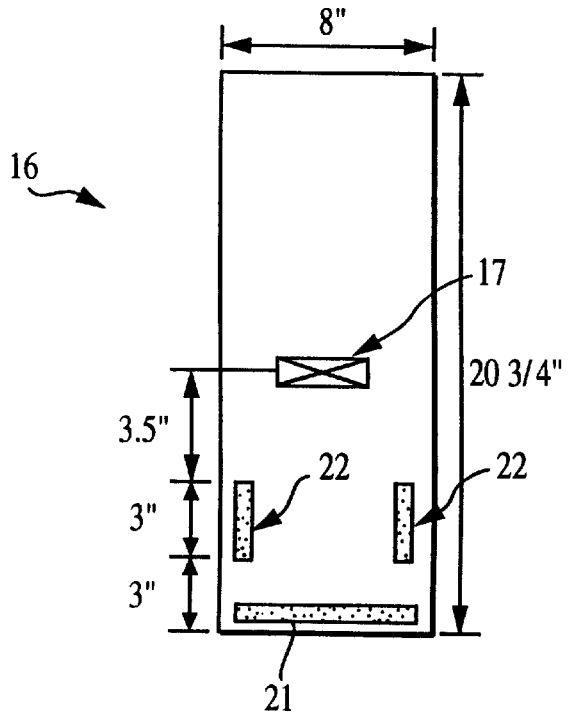
FIGS. 10(*a*) and 10(*b*) illustrate two surfaces, respectively, of a cover for storing and deploying a ladder, designed for use from a second-floor window, when in a flat, laid-out position. These figures show the dimensions of the cover and the positioning of temporary fasteners (which may be formed of hooks and loops, for example), on the cover which enable the cover to perform three functions, as described in the detailed description, below; and, FIGS. 11(*a*) and 11(*b*) illustrate two surfaces, respectively, of a cover for storing and deploying a ladder, designed for use from a third-floor window, when in a flat, laid-out position. These figures show the dimensions of the cover and the positioning of temporary fasteners on the cover which enable the cover to perform the same three functions as the cover illustrated in FIGS. 10(*a*) and 10(*b*).
Figure 10B:
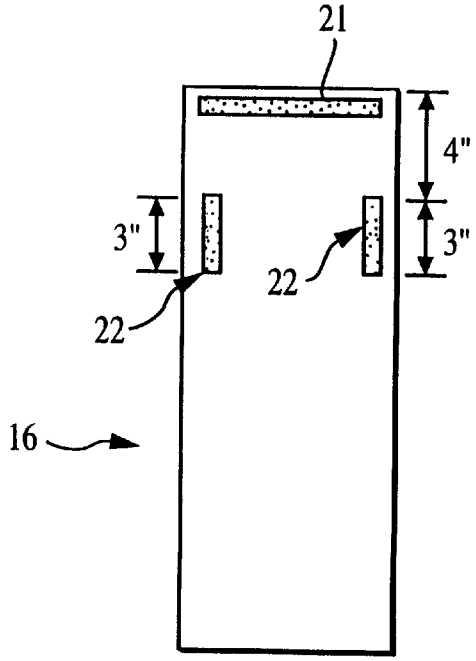

FIGS. 10(*a*) and 10(*b*) illustrate the two opposite surf aces of a cover 16, of rectangular shape, useful for storing and deploying a ladder designed for use from a second-floor window. Because of the high degree of nesting of the rungs of the ladder according to the present invention, the stack of rungs for a ladder for use from a second-floor window measures only about 6 inches in height, there being about 11–12 rungs for such a length of ladder. The figures show the cover in a flat, laid-out position, and give the dimensions of the cover 16 and the positioning of the handle 17 as well as the locations of various sets of temporary fasteners which enable the cover to perform three functions.

A first function of the cover is to wrap securely around the entire ladder including the multiple rungs and the attaching member so that the ladder 1 may be lifted with one hand to a window from which it is to be deployed. A first set of temporary fasteners 21 (formed, for example, of mating hooks and loops and sold under the name VELCRO) are positioned near opposite ends of the cover, and on opposite sides of the cover, as shown respectively in FIGS. 10(*a*) and 10(*b*). FIG. 10(*a*) illustrates the side of the cover that has the handle 17 attached, and this side is the side that is visible in FIG. 8. FIG. 10(*b*) illustrates the opposite side of the cover from that shown in FIG. 10(*a*). The temporary fastener 21 at the bottom and on one side of the cover attaches to, and is detachable from, a mating temporary fastener 21 at the top and on the other side of the cover. This enables the ladder 1, including both the multiple rungs 5 and the attaching member (with the open hooks of the attaching member looped over the stack of multiple rungs, as shown in FIG. 8) to be picked up with one hand via the handle 17. The user's other hand then is free to pull apart the temporary fasteners 21 so that the cover opens partially to allow the attaching member 2 with the attached narrow fabric supports 4 (down to the top rung) to be lifted from the stack of multiple rungs and positioned in place on the sill of the window. To facilitate the placement of the attaching member over the window sill the mounting plate 18, shown in FIGS. 9(*a*) and 9(*b*), may optionally be employed.

The second function performed by the cover is to support the multiple rungs of the ladder using the handle once the attaching member has been removed from the cover by releasing the temporary fasteners 21. This function is enabled by a second set of temporary fasteners 22 that hold the remainder of the cover so as to securely wrap the stacked and nested ladder rungs, thereby enabling the multiple stacked and nested rungs to be maintained in an organized packet during and after placing the attaching member 2 over the window sill. The two sets of temporary fasteners 22 (which also may be formed, for example, of mating hooks and loops) are positioned a distance inward from each end of the cover. After positioning the attaching member 2 securely over the window sill using one's free hand, the hand holding the handle is then positioned outside the window and, after ensuring that the narrow fabric supports have not inadvertently become twisted, the cover is merely dropped by releasing the handle in order to fully deploy the ladder.

The third function of the cover is to allow the momentum of the falling set of multiple, stacked rungs to pull apart temporary fasteners 22 on the cover so as to allow the rungs to automatically deploy after the handle is dropped. As illustrated in FIGS. 10(*a*) and 10(*b*), for a two-story ladder, the cover measures about 8 inches by 20 and ¾ inches, and the temporary fasteners 22 are positioned about 3 to 4 inches from the ends of the cover, in the long dimension.

Figure 11A:
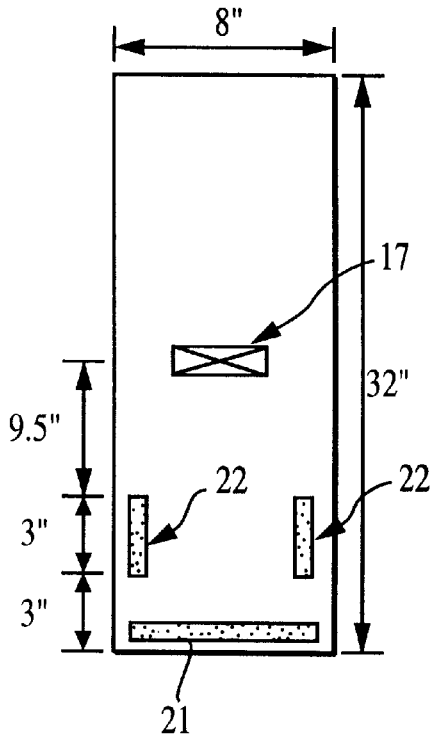
Figure 11B:
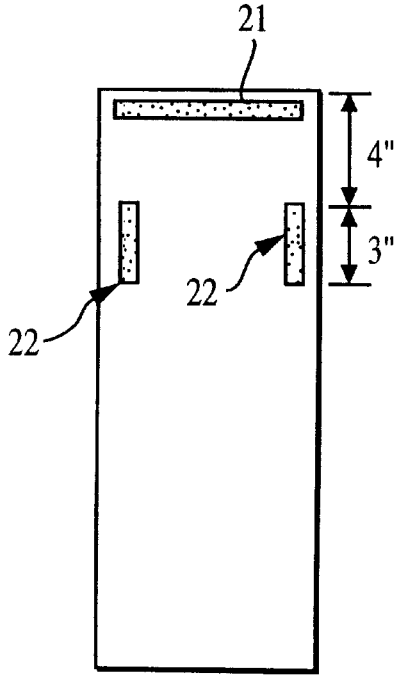

FIGS. 11(*a*) and 11(*b*) illustrate the two surfaces of the cover 16 for a ladder 1 designed for use from a third-floor window when in a flat, laid-out position, and shows the positioning of the sets of temporary fasteners 21, 22 on the cover. Because of the high degree of nesting of the rungs of the ladder according to the present invention, the stack of rungs for a ladder for use from a third-floor window measures only about 12 inches in height, there being about 12–24 rungs for such a length of ladder. As illustrated in FIGS. 11(*a*) and 11(*b*), for a ladder for use from a third floor, the cover measures about 8 inches by 32 pinches. The set of mating temporary fasteners 21 are positioned as indicated, on opposite sides and at opposite ends of the cover. Each of temporary fasteners 22 is positioned about 3 to 4 inches from the ends of the cover, in the long dimension as illustrated, so that the cover securely wraps the multiple rungs even after the attaching member 2 has been removed from within the cover by detaching the temporary fasteners 21.

The ladder may be readily deployed from the collapsed state by a single individual using the cover in the following manner. First, the cover 16 is partially opened by releasing the first set of temporary fasteners 21. Then, while holding the handle 17 with one hand, the attaching member 2 is lifted (using one's other hand) from the stack of multiple rungs and placed over a window sill. Then, while maintaining an orientation of the cover such that the narrow fabric supports between the attaching member and the top rung are not twisted, the handle is held out the window and dropped. The ladder is then automatically deployed by the momentum of the falling multiple ladder rungs reaching "tie end of their rope" so to speak.

The invention being thus described, it will be obvious that the invention can be varied in many ways. For example, all of the rungs need not be made of the same material or be of the same general form Such variations are not to be regarded as a departure from the spirit and scope of the invention, and all such modifications as would be obvious to one skilled in the art are intended to be included within the scope of the following claims.

What is claimed is:

1. A collapsible escape ladder comprising:

an attaching member, said attaching member for attaching said escape ladder over a window sill of a building;

multiple ladder rungs, each formed with an elongated first portion and at least two stand-off projections, said two stand-off projections extending transverse to the longer dimension of the first portion at opposite ends thereof in the longer dimension, said first portion being of a thickness and with a cross-section so as to enable the multiple ladder rungs to nest when stacked in the collapsed state, each said rung including at least two slot openings near each opposite end of each rung, each slot opening having a longer dimension that is transverse to the longer dimension direction of the first portion, said at least two slot openings being at different locations along the longer dimension of the first portion so as to enable a webbing support to be sequentially threaded through said two slot openings such that the points of departure of the webbing support above and below said rung are staggered in the direction of elongation of the elongated first portion; and a webbing support that is sequentially threaded through said at least two slot openings of a given rung and said at least two slot openings of an adjacent rung such that the points of departure of the webbing support from the at least two slot openings above and below a respective rung are staggered in the longer dimension of the first portion, said webbing support being sequentially threaded from outside an outer end edge of a respective end of said given rung and through the at least two slot openings of said given rung and to said adjacent rung, said webbing support being attached to said attaching member.

2. The collapsible escape ladder as set forth in claim 1, wherein said webbing of support measures about ⅛ inch in thickness and about 1 inch in width.

3. The collapsible ladder of claim 1, said ladder having at least 10 rungs each 6 inches when the ladder rungs are stacked.

* * * * *

UNITED STATES PATENT AND TRADEMARK OFFICE

CERTIFICATE OF CORRECTION

PATENT NO. : 6,279,681 B1
DATED : August 28, 2001
INVENTOR(S) : DiBelardino et al.

It is certified that error appears in the above-identified patent and that said Letters Patent is hereby corrected as shown below:

Title page,
Item [12], change "Dibelardino et al." to -- DiBelardino et al. --;
Item [75], inventors, change "Dibelardino" (two occurrences) to -- DiBelardino --;
Item [75], change the citizenship of inventor Andrew D. Ive from: "(US)" to -- (U.K.) --;
Item [56], FOREIGN PATENT DOCUMENTS, delete the last listed document, namely: -- 211216 * 7/1966 (SE) --;
Item [57], ABSTRACT,
Line 16, change "of the filling" to -- of the falling --;

Column 7,
Line 34, change ""tie" to -- "the --; and

Column 8,
Line 2, change "webbing of support" to -- webbing --.

Signed and Sealed this

Fourth Day of February, 2003

JAMES E. ROGAN
*Director of the United States Patent and Trademark Office*